US007185434B2

(12) United States Patent
Chiu et al.

(10) Patent No.: US 7,185,434 B2
(45) Date of Patent: Mar. 6, 2007

(54) HEAT SINK VACUUM PACKAGING PROCEDURE

(75) Inventors: Liu-Ho Chiu, Taipei (TW); Chang-Hui Wu, Taipei (TW); Ming-Der Chou, Taipei (TW); Chen-Ming Chang, Taipei (TW)

(73) Assignee: Tatung Co., Ltd., Taipei (TW)

( * ) Notice: Subject to any disclaimer, the term of this patent is extended or adjusted under 35 U.S.C. 154(b) by 598 days.

(21) Appl. No.: 10/793,783

(22) Filed: Mar. 8, 2004

(65) Prior Publication Data

US 2005/0091828 A1 May 5, 2005

(30) Foreign Application Priority Data

Nov. 4, 2003 (TW) ..... 92130940 A

(51) Int. Cl.
*B21D 53/02* (2006.01)

(52) U.S. Cl. ..... 29/890.03; 29/509; 29/510; 29/511; 165/104.26

(58) Field of Classification Search ..... 29/890.03, 29/509, 510, 511, 422, 530; 156/104.26
See application file for complete search history.

(56) References Cited

U.S. PATENT DOCUMENTS

| | | | | |
|---|---|---|---|---|
| 6,561,004 | B1 * | 5/2003 | Neiner et al. | 72/715 |
| 6,871,701 | B2 * | 3/2005 | Ueki et al. | 165/104.26 |
| 2001/0022219 | A1 * | 9/2001 | Ikeda et al. | 165/46 |
| 2003/0136550 | A1 * | 7/2003 | Tung et al. | 165/104.26 |
| 2005/0092467 | A1 * | 5/2005 | Lin et al. | 165/104.26 |

* cited by examiner

*Primary Examiner*—Marc Jimenez
(74) *Attorney, Agent, or Firm*—Bacon & Thomas, PLLC

(57) ABSTRACT

A heat sink vacuum packaging procedure to rapidly complete the packaging of a heat sink without drilling, pipe welding, vacuum pumping, or other processes. Because the packaging procedure saves much time and labor, the manufacturing cost of the heat sink is relatively reduced. During packaging, no welding process is employed, therefore the invention prevents accidentally flowing of tin solder into the inside of the heat sink to affect the quality of the heat sink, and the quality of the heat sink is maintained.

6 Claims, 5 Drawing Sheets

HEAT SINK VACUUM PACKAGING PROCEDURE

BACKGROUND OF THE INVENTION

1. Field of the Invention

The present invention relates to a heat sink vacuum packaging procedure and, more particularly, to a packaging procedure adapted to package a steam chamber type heat sink for use to dissipate heat from the CPU of a computer.

2. Description of Related Art

FIG. 1 is an exploded view of a conventional steam chamber type heat sink. According to a conventional packaging method, the heat sink upper cover 91 and the heat sink bottom cover 92 are abutted against each other and then peripherally sealed by welding, defining an enclosed chamber 93. Thereafter, a through hole 911 is formed in the heat sink upper cover 91 by drilling, and then a connector 94 is welded to the periphery of the through hole 911 and connected to a vacuum pump (not shown), which is operated to draw the enclosed chamber 93 into a vacuum status. At final, pure water is filled through the connector 94 into the enclosed chamber 93, and then the connector 94 is sealed up by welding. The aforesaid conventional steam chamber type heat sink packaging procedure is complicated and requires much labor and time, resulting in high manufacturing cost. Further, tin solder may flow into the inside of the heat sink during welding, affecting the quality of the heat sink.

SUMMARY OF THE INVENTION

The present invention has been accomplished to provide a heat sink vacuum packaging procedure, which eliminates the drawbacks of the aforesaid conventional method. It is the main object of the present invention to provide a heat sink vacuum packaging procedure, which requires less time and labor, reduces the heat sink manufacturing cost, and improves the heat sink quality.

To achieve this object, the heat sink vacuum packaging procedure comprises the steps in series of:

(a) delivering a heat sink upper cover and a heat sink bottom cover to a vacuum chamber, the heat sink upper cover having a coupling flange extended around the periphery thereof, the heat sink bottom cover having a coupling flange extended around the periphery thereof;

(b) filling pure water in the heat sink upper cover and the heat sink bottom cover;

(c) turning the heat sink upper cover and then closing the heat sink upper cover on the heat sink bottom cover for enabling the coupling flange of the heat sink upper cover to be covered on the coupling flange of the heat sink bottom cover;

(d) operating a first ramming roller to ram the coupling flange of the heat sink upper cover at an anvil and to deform the coupling flange of the heat sink upper cover, causing the coupling flange of the heat sink upper cover to be preliminary curved and to hook the coupling flange of the heat sink bottom cover;

(e) operating a second ramming roller to ram the coupling flange of the heat sink upper cover and the coupling flange of the heat sink bottom cover at the anvil, and to deform the coupling flange of the heat sink upper cover and the coupling flange of the heat sink bottom cover, thereby causing the coupling flange of the heat sink upper cover to be sealed tightly to the coupling flange of the heat sink bottom cover; and (f) delivering the packaged heat sink upper cover and heat sink bottom cover out of the vacuum chamber.

As indicated, the invention employs a continuous flow to rapidly achieve the packaging of the heat sink. During packaging, it is not necessary to treat the heat sink upper cover or heat sink bottom cover with any additional processing process such as conventional drilling, welding, vacuum pumping. Therefore, the invention shortens the packaging of the heat sink, saves much labor and time, and reduces the manufacturing cost of the heat sink. Further, because no welding process is needed in the aforesaid packaging procedure, the invention eliminates the problem of accidentally flowing of tin solder into the inside of the heat sink during packaging, improving the quality of the heat sink.

DETAILED DESCRIPTION OF THE PREFERRED EMBODIMENT

Figure 1:
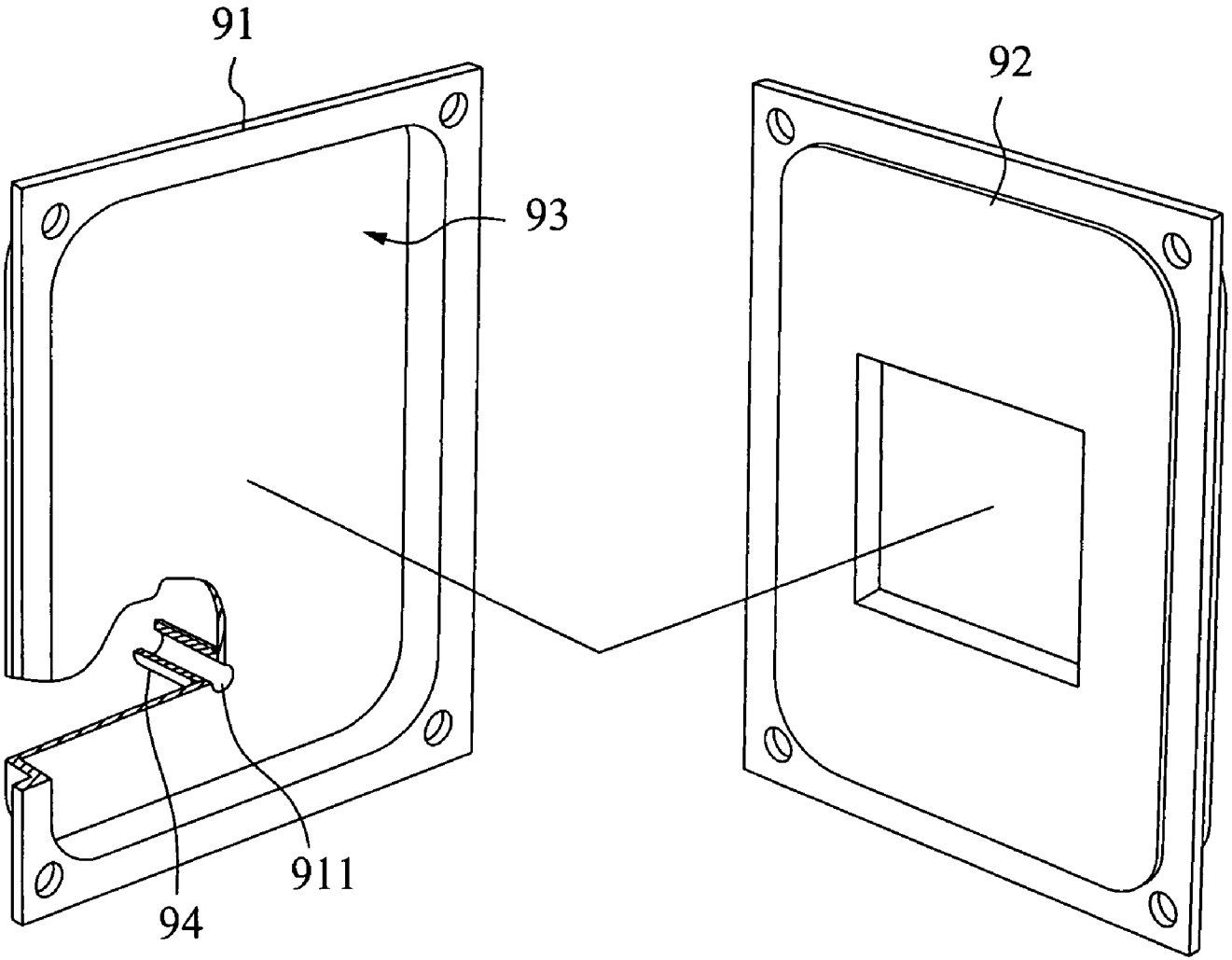
Fig.1(Prior Art)
FIG. 1 is an exploded view of a steam chamber type heat sink according to the prior art.

The present invention will now be described by way of example with reference to FIGS. 2 and 3, at first, use a conveyer 4 to carry a heat sink upper cover 11 and a heat sink bottom cover 12 to a vacuum chamber 2 (SA). The heat sink upper cover 11 and the heat sink bottom cover 12 have a respective peripheral coupling flange 111 or 121. These coupling flanges 111 and 121 both have a U-shaped profile concaved downwardly (see FIG. 4).

After the heat sink upper cover 11 and the heat sink bottom cover 12 have been delivered to the vacuum chamber 2, a pure water injector 5 is operated to inject pure water into the inside space of the heat sink upper cover 11 and the inside space of the heat sink bottom cover 12 (SB). At this time, pure water is adhered to the inside of the heat sink upper cover 11 and the heat sink bottom cover 12 by means of the capillary cohesive force of the heat sink upper cover 11 and the heat sink bottom cover 12.

Figure 2:
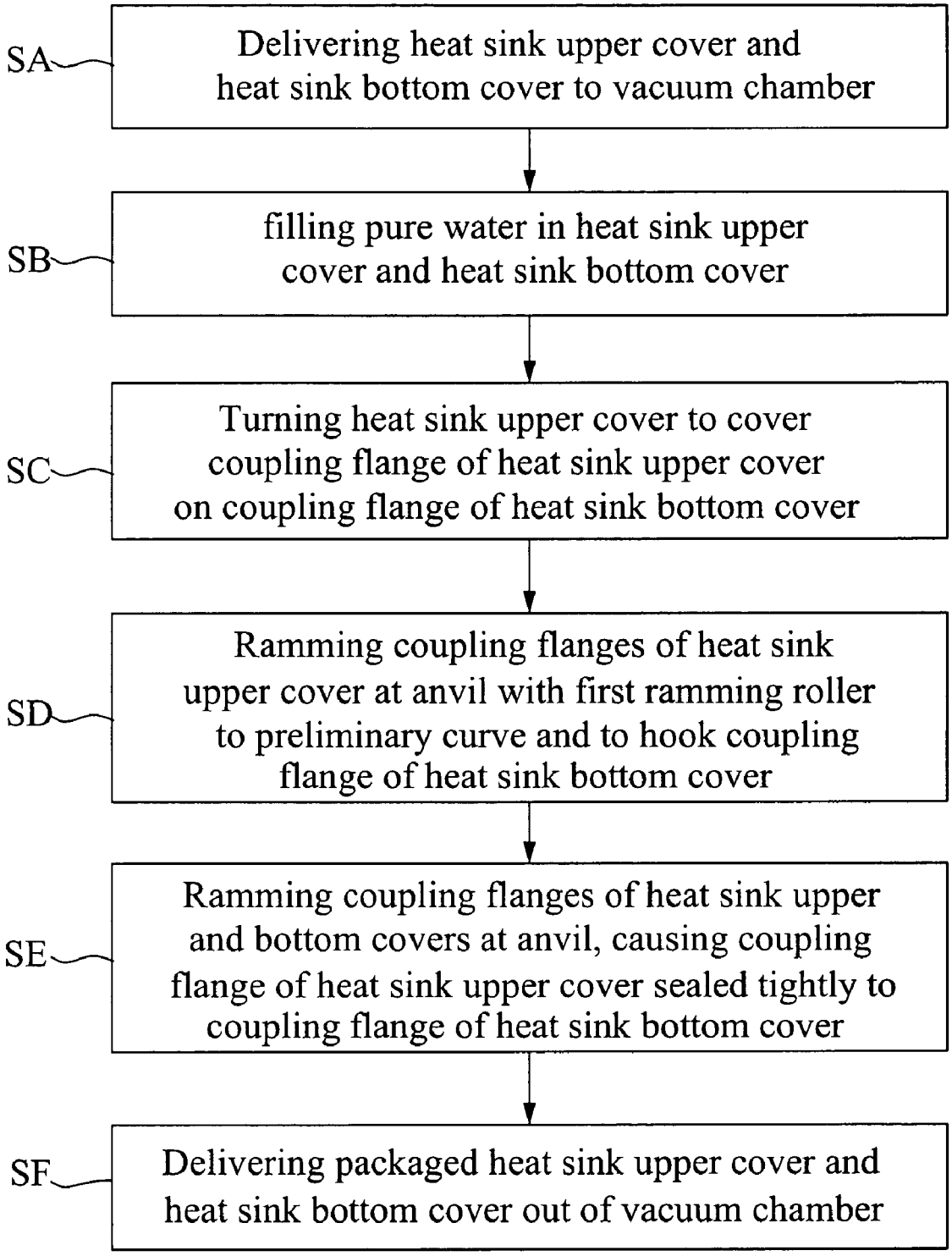
FIG. 2 is a heat sink vacuum packaging procedure flow chart according to the present invention.
Figure 3:
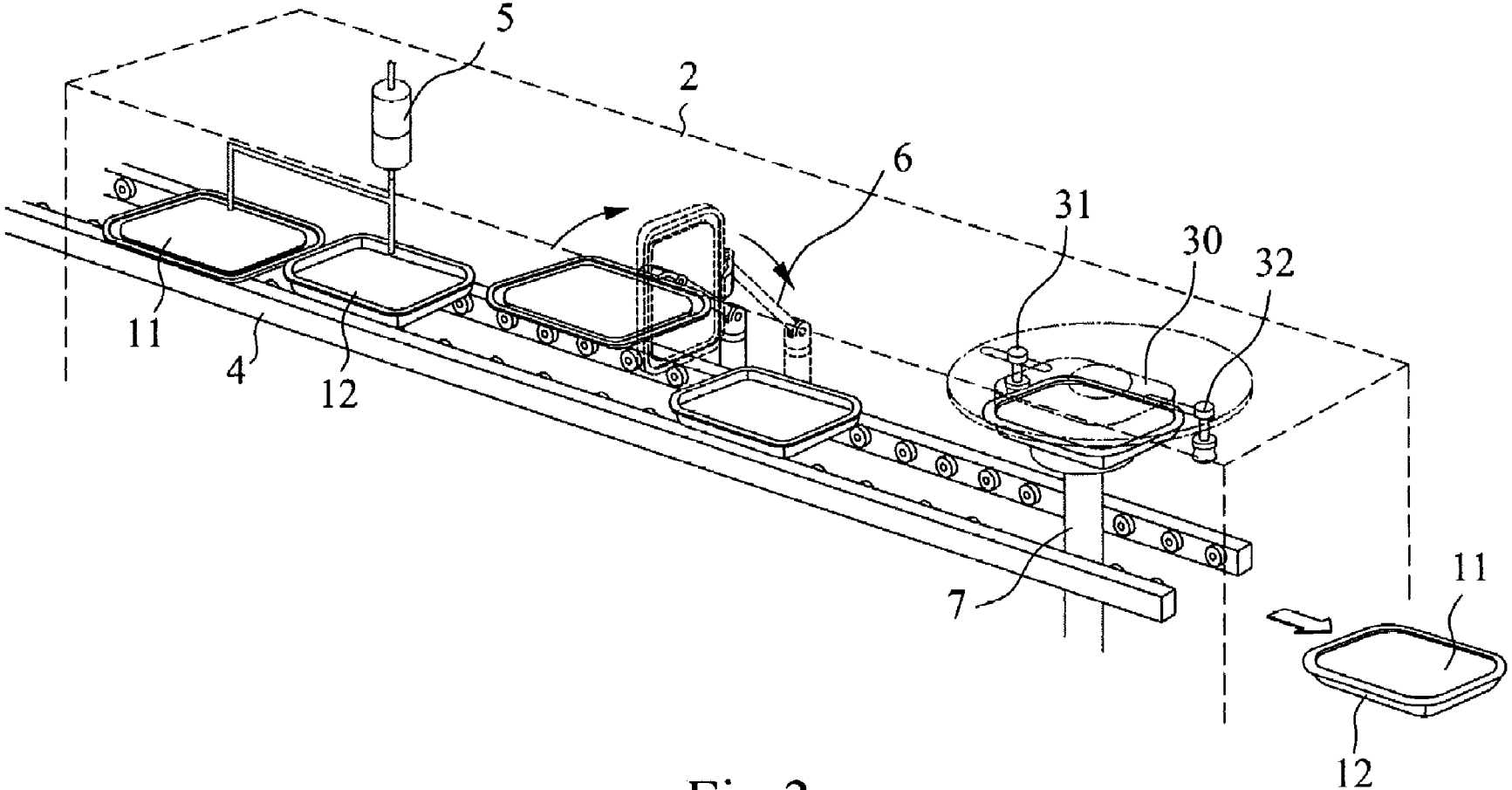
FIG. 3 illustrates the system architecture according to the present invention.
Figure 4:
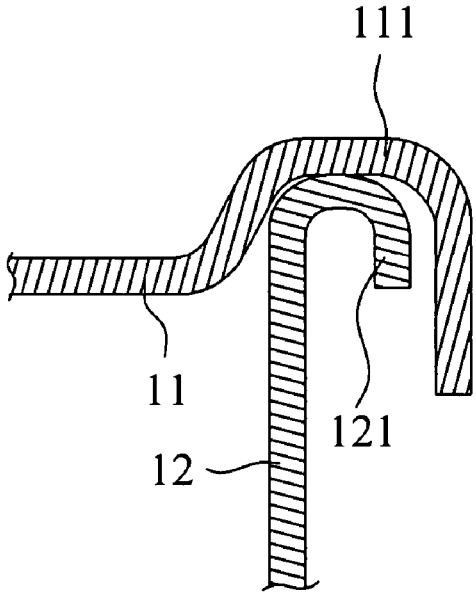
FIG. 4 is a schematic drawing showing the heat sink upper cover covered on the heat sink bottom cover according to the present invention.

Referring to FIGS. 2–4 again, after injection of pure water by the pure water injector 5 into the heat sink upper cover 11 and the heat sink bottom cover 12, a robot 6 is operated to turn the heat sink upper cover 11 and to close the heat sink upper cover 11 on the heat sink bottom cover 12 (SC). At this time, the U-shaped coupling flange 111 of the heat sink upper cover 11 is covered on the U-shaped coupling flange 121 of the heat sink bottom cover 12 as shown in FIG. 4.

Figure 5:
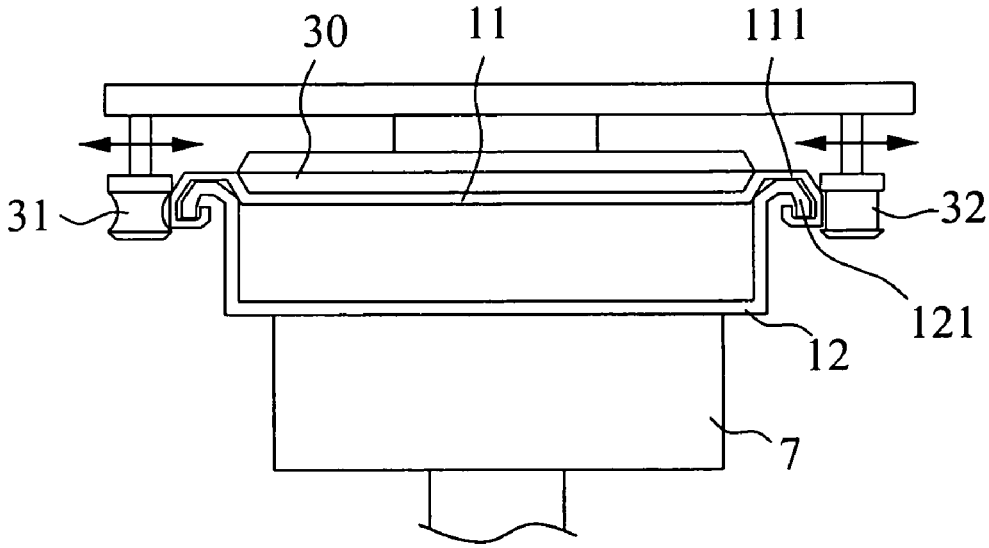
FIG. 5 is a schematic drawing showing the arrangement of the shape-forming fixture according to the present invention.
Figure 6:
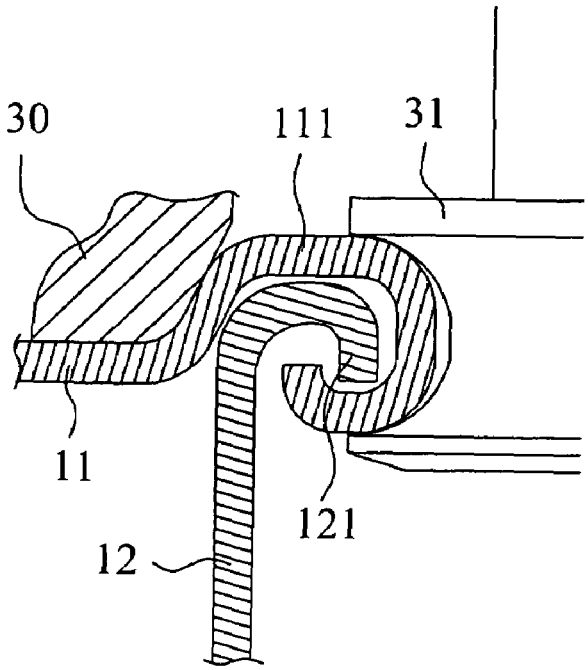
FIG. 6 is a schematic drawing showing the coupling flange of the heat sink upper cover hooked in the coupling flange of the heat sink bottom cover according to the present invention.

Referring to FIGS. 5 and 6 and FIGS. 2 and 3 again, after covering of the heat sink upper cover 11 on the heat sink bottom cover 12, a pneumatic lifting mechanism 7 is operated to lift the covered heat sink upper cover 11 and heat sink bottom cover 12 to the first ramming roller 31 and anvil 30 of a shape-forming fixture, and then the first ramming roller 31 is rotated and moved leftwards and rightwards to ram the coupling flanges 111 of the heat sink upper cover 11 at the anvil 30, thereby causing the coupling flange 111 of the heat sink upper cover 11 to be deformed and preliminary curved and hooked in the coupling flange 121 of the heat sink bottom cover 12 (SD) as shown in FIG. 6.

Figure 7:
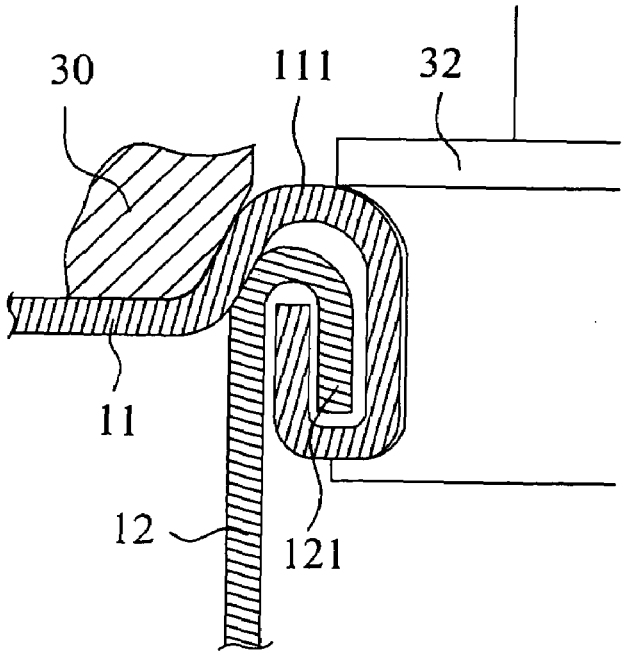
FIG. 7 is a schematic drawing showing the coupling flange of the heat sink upper cover and the coupling flange of the heat sink bottom cover completely sealed together.

Referring to FIG. 7 and FIGS. 2, 3, and 5 again, after the aforesaid primary ramming by the first ramming roller 31 of the aforesaid shape-forming fixture, the second ramming roller 32 of the shape-forming fixture is rotated and moved leftwards and rightwards to ram the coupled coupling flanges 111 and 121 at the anvil 30, and to deform the coupling flange 111 of the heat sink upper cover 11 and the coupling flange 121 of the heat sink bottom cover 12, thereby causing the coupling flange 111 of the heat sink upper cover 11 and the coupling flange 121 of the heat sink bottom cover 12 to be tightly sealed together (SE).

Referring to FIGS. 2 and 3 again, at final, the conveyer 4 is operated to carry the packaged heat sink upper cover 11 and heat sink bottom cover 12 out of the vacuum chamber 2 (SF).

By means of the aforesaid continuous flow, the heat sink upper cover 11 and the heat sink bottom cover 12 are rapidly packed. During the packaging procedure, it is not necessary to treat the heat sink upper cover 11 or the heat sink bottom cover 12 with any processing process such as conventional drilling, pipe welding, vacuum pumping. Therefore, the aforesaid flow actually shortens the packaging procedure and minimizes the consumption of labor and time, reducing the manufacturing cost of the heat sink.

Because no welding process is needed in the aforesaid packaging procedure, the invention eliminates the problem of accidentally flowing of tin solder into the inside of the heat sink during packaging, improving the quality of the heat sink.

Although the present invention has been explained in relation to its preferred embodiment, it is to be understood that many other possible modifications and variations can be made without departing from the spirit and scope of the invention as hereinafter claimed.

What is claimed is:

1. A heat sink vacuum packaging procedure comprising the steps in series of:

(a) delivering a heat sink upper cover and a heat sink bottom cover to a vacuum chamber, said heat sink upper cover having a coupling flange extended around the periphery thereof, said heat sink bottom cover having a coupling flange extended around the periphery thereof;

(b) filling pure water in said heat sink upper cover and said heat sink bottom cover;

(c) turning said heat sink upper cover and then closing said heat sink upper cover on said heat sink bottom cover for enabling the coupling flange of said heat sink upper cover to be covered on the coupling flange of said heat sink bottom cover;

(d) operating a first ramming roller to ram the coupling flange of said heat sink upper cover at an anvil and to deform the coupling flange of said heat sink upper cover, causing the coupling flange of said heat sink upper cover to be preliminary curved and to hook the coupling flange of said heat sink bottom cover;

(e) operating a second ramming roller to ram the coupling flange of said heat sink upper cover and the coupling flange of said heat sink bottom cover at said anvil, and to deform the coupling flange of said heat sink upper cover and the coupling flange of said heat sink bottom cover, thereby causing the coupling flange of said heat sink upper cover to be sealed tightly to the coupling flange of said heat sink bottom cover; and (f) delivering the packaged heat sink upper cover and heat sink bottom cover out of said vacuum chamber.

2. The heat sink vacuum packaging procedure as claimed in claim 1, wherein the coupling flange of said heat sink upper cover and the coupling flange of said heat sink bottom cover both have a substantially U-shaped profile concaved downwardly.

3. The heat sink vacuum packaging procedure as claimed in claim 1, wherein said heat sink upper cover and said heat sink bottom cover are delivered to said vacuum chamber during step (a) by a conveyer.

4. The heat sink vacuum packaging procedure as claimed in claim 1, wherein said pure water is filled in said heat sink upper cover and said heat sink bottom cover during step (b) by a pure water injector.

5. The heat sink vacuum packaging procedure as claimed in claim 1, wherein said heat sink upper cover is turned and covered on said heat sink bottom cover during step (c) by a robot.

6. The heat sink vacuum packaging procedure as claimed in claim 1, wherein said heat sink upper cover and said heat sink bottom cover are lifted to said first ramming roller and said second ramming roller for ramming during step (d) and step (e) respectively by a pneumatic lifting mechanism.

* * * * *